US007627282B2

(12) United States Patent
Oka et al.

(10) Patent No.: US 7,627,282 B2
(45) Date of Patent: Dec. 1, 2009

(54) IMAGE FORMING APPARATUS FOR DESIGNATING SHEET POST-PROCESSING FUNCTIONS

(75) Inventors: Yushi Oka, Abiko (JP); Manabu Yamauchi, Kashiwa (JP); Naoto Watanabe, Abiko (JP); Takayuki Fujii, Toshima-ku (JP); Shunsuke Nishimura, Toride (JP); Toshiyuki Miyake, Toride (JP); Takashi Yokoya, Kashiwa (JP)

(73) Assignee: Canon Kabushiki Kaisha (JP)

( * ) Notice: Subject to any disclaimer, the term of this patent is extended or adjusted under 35 U.S.C. 154(b) by 39 days.

(21) Appl. No.: 11/466,605

(22) Filed: Aug. 23, 2006

(65) Prior Publication Data

US 2007/0047996 A1 Mar. 1, 2007

(30) Foreign Application Priority Data

Aug. 30, 2005 (JP) ..... 2005-250117

(51) Int. Cl.
*G03G 15/00* (2006.01)

(52) U.S. Cl. ..... 399/410; 399/82; 399/411

(58) Field of Classification Search ..... 399/82, 399/410, 411

See application file for complete search history.

(56) References Cited

U.S. PATENT DOCUMENTS 5,746,162 A * 5/1998 Hosoi et al. ..... 270/37
6,076,817 A * 6/2000 Kobayashi et al. ..... 270/58.09
6,088,568 A * 7/2000 Ohtani ..... 399/408
6,711,365 B2 * 3/2004 Ohtani ..... 399/82
7,261,288 B2 * 8/2007 Hosoya et al. ..... 270/58.07
2002/0054008 A1 * 5/2002 Aikawa ..... 345/100
2003/0062666 A1 * 4/2003 Hosoya et al. ..... 270/58.07
2003/0198494 A1 * 10/2003 Kenji et al. ..... 399/381
2006/0088331 A1 * 4/2006 Inoue et al. ..... 399/81

* cited by examiner

*Primary Examiner*—David M Gray
*Assistant Examiner*—G. M. Hyder
(74) *Attorney, Agent, or Firm*—Rossi, Kimms & McDowell, LLP

(57) ABSTRACT

An image forming apparatus including: a stapling device which applies staple processing to a portion assuming a trailing end of a sheet with respect to a transport direction of the sheet; a first punch device which applies punch processing to a portion assuming a leading end of the sheet in the transport direction of the sheet; and a second punch device which applies the punch processing to the portion assuming the trailing end of the sheet in the transport direction of the sheet, in which a setting of both a staple mode for performing the staple processing by the stapling device and a first punch mode for performing the punch processing by the first punch device is inhibited, and a setting of both the staple mode and a second punch mode for performing the punch processing by the second punch device is allowed.

12 Claims, 13 Drawing Sheets

| NAME OF UNIT | END POSITION TO BE PROCESSED |
|---|---|
| STAPLE UNIT | TRAILING END |
| FIRST PUNCH UNIT | LEADING END |
| SECOND PUNCH UNIT | TRAILING END |

IMAGE FORMING APPARATUS FOR DESIGNATING SHEET POST-PROCESSING FUNCTIONS

BACKGROUND OF THE INVENTION

1. Field of the Invention

The present invention relates to an image forming apparatus capable of designating functions of stapling and punching with respect to a sheet.

2. Description of the Related Art

As a sheet processing apparatus for performing post-processing with respect to a sheet delivered from an image forming apparatus, there is a sheet processing apparatus including a punch unit for performing punch processing, and a staple unit for performing staple processing (e.g., see U.S. Pat. No. 5,746,162). In the sheet processing apparatus, it is possible to perform both the punch processing and the staple processing with respect to a sheet.

In the punch processing, it is possible to designate the number, a size, a position, and the like of punch-holes, from an operation part of the image forming apparatus, and to mount on the sheet processing apparatus the punch unit corresponding to a designated content.

In the staple processing, it is possible to designate the staple position (binding position) with respect to one end of a sheet and the number of staple positions. For example, it is possible to designate to staple sheets along one end thereof at one position near a front edge, at one position near a back edge, or at two positions.

However, when the punch processing and the staple processing are performed at the same time, there is a possibility that designation is performed such that the punch processing and the staple processing interfere with each other. When such the designation is performed, a failure may occur in a product. Therefore, in order to prevent the failure from occurring, in the above-mentioned sheet processing apparatus, it is determined whether or not the designated punch position and staple position interfere with each other, and when the positions thereof interfere with each other, control for inhibiting a staple operation performed by the staple unit is performed.

The staple unit has a structure in which the staple processing is performed with respect to a portion which is a trailing end of a sheet with respect to a transport direction of the sheet.

As the punch unit, there are a small-number-hole punch unit for punching a small number of holes, for example, two to four holes, a thirty-hole punch unit for punching a thirty of holes, for example, twenty-six or thirty holes, and the like. The small-number-hole punch unit performs the punch processing with respect to a trailing end of a sheet (i.e., a portion which is the trailing end of the sheet with respect to the transport direction of the sheet). On the other hand, the thirty-hole punch unit often has a structure for performing the punch processing with respect to a leading end of the sheet (i.e., a portion which is the leading end of the sheet with respect to the transport direction of the sheet).

When the punch processing is applied to the trailing end of the sheet, it is necessary to switch back a sheet to be transported and abut the trailing end of the sheet against an abutting member so as to enhance accuracy of the punch processing. Then, the punch processing is performed with respect to the sheet of which trailing end is abutted against the abutting member. In this case, there is a disadvantage that productivity is lowered by switching back the sheet.

On the other hand, when the punch processing is applied to the leading end of the sheet, the abutting member is used in a similar manner as in the punch processing applied to the trailing end of the sheet. However, it is unnecessary to switch back the sheet, so there is an advantage in productivity compared with the case where the punch process is applied to the trailing end of the sheet. As a result, the thirty-hole punch unit often has a structure in which the punch processing is applied to the leading end of the sheet from the viewpoint of the accuracy and productivity of the sheet, as described above.

For example, a case where thirty-hole punch processing and staple processing are sequentially performed by using the thirty-hole punch unit for performing the punch processing with respect to the leading end of the sheet will be described with reference to FIG. 18.

FIG. 18 is a diagram showing an example of a product obtained in the case where the thirty-hole punch processing and the staple processing are performed with respect to the leading end of the sheet by using the thirty-hole punch unit in a conventional sheet processing apparatus.

In this case, a punch position is set to a leading end side of the sheet, and the staple position is set to a trailing end side of the sheet. Thus, in the conventional control described above, the punch position and the staple position do not interfere with each other, so the staple operation performed by the staple unit is not inhibited, and both the thirty-hole punch processing and the staple processing are executed. As a result, as shown in FIG. 18, the product in which the punch processing and the staple processing are applied to different ends of a sheet is outputted. However, such the product is not desirable for a user.

SUMMARY OF THE INVENTION

An object of the present invention is to provide an image forming apparatus in which the above-mentioned disadvantage is eliminated.

Another object of the present invention is to provide an image forming apparatus capable of preventing in advance a setting by an inappropriate combination of a staple mode and a punch mode from being performed.

According to a first aspect of the present invention, there is provided an image forming apparatus, including an image forming device which forms an image on a sheet, a stapling device which applies staple processing to a portion assuming a trailing end of the sheet with respect to a transport direction of the sheet, a first punch device which applies punch processing to a portion assuming a leading end of the sheet with respect to a transport direction of the sheet, a second punch device which applies the punch processing to the portion assuming the trailing end of the sheet with respect to the transport direction of the sheet, a mode setting device which sets a post-processing mode including a staple mode for performing the staple processing by the stapling device, a first punch mode for performing the punch processing by the first punch device, and a second punch mode for performing the punch processing by the second punch device, and a controller which inhibits a setting of both the staple mode and the first punch mode, and allows a setting of both the staple mode and the second punch mode.

Further features of the present invention will become apparent from the following description of exemplary embodiments with reference to the attached drawings.

DESCRIPTION OF THE EMBODIMENTS

Hereinafter, embodiments of the present invention will be described with reference to the drawings.

First Embodiment

Figure 1:
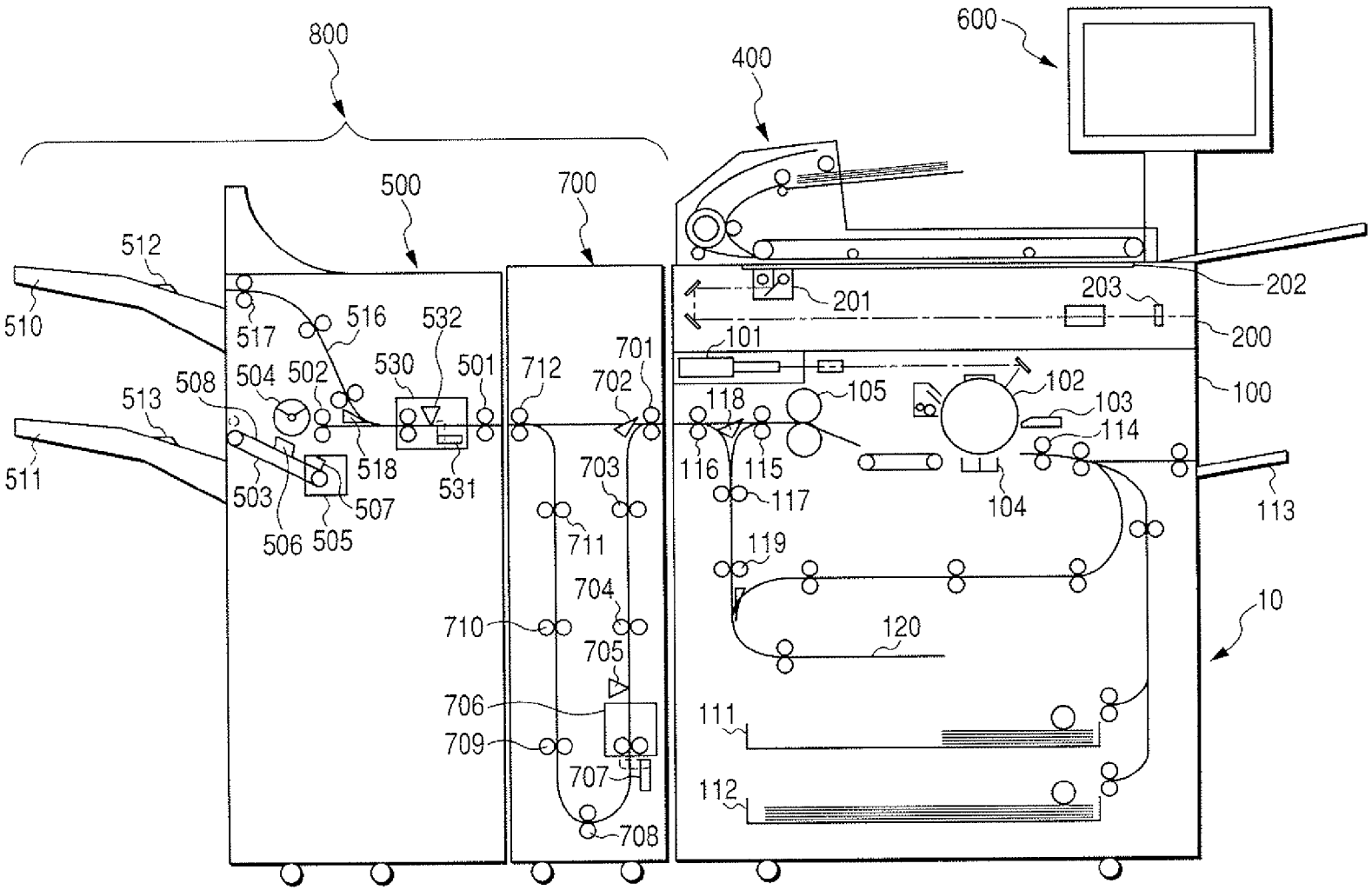
FIG. 1 is a longitudinal sectional view showing an internal structure of a whole image forming apparatus according to a first embodiment of the present invention.

FIG. 1 is a longitudinal sectional view showing an internal structure of a whole image forming apparatus according to a first embodiment of the present invention.

An image forming apparatus 10 is provided with an image reader 200, a printer 100, a finisher 800, and an operation displaying device 600. Here, the image reader 200 and the printer 100 are constituted in an integrated manner. The finisher 800 is constituted to be detachably mounted to the printer 100. In addition, the operation displaying device 600 is provided to the image reader 200.

The image reader 200 is mounted with an original feeding device 400. The original feeding device 400 feeds originals, which are set upwardly on an original tray, one by one leftward (viewed from a front surface of the apparatus) in the order from the top page, and then transports the originals to a predetermined position on platen glass (i.e., an original plate) 202 through a curved path. The original transported to the predetermined position on the platen glass 202 are scanned by a scanner unit 201 from left to right, thereby reading an image formed on the original. When the scanner unit 201 scans the original, a reading surface of the original is irradiated with lamp light of the scanner unit 201, and then reflected light from the original is guided into a lens through a mirror. The light passing through the lens forms an image as an optical image on an image pickup surface of an image sensor 203. The optical image is converted into image data by the image sensor 203 to be outputted. The image data outputted by the image sensor 203 is inputted to an exposure controlling portion 101 of the printer 100 as a video signal after predetermined processing is performed in an image signal controlling portion 281 to be described below.

Next, a case where an image is formed on one surface of the sheet will be described.

The exposure controlling portion 101 of the printer 100 modulates a laser beam based on the inputted video signal, and outputs the modulated laser beam. The outputted laser beam is irradiated on a photosensitive drum 102 while being scanned by a polygon mirror (not shown) or the like. On the photosensitive drum 102, an electrostatic latent image according to the scanned laser beam is formed.

The electrostatic latent image formed on the photosensitive drum 102 is visualized as a developer image by a developer supplied from a developing device 103. Further, a sheet is fed from cassettes 111 and 112, or from a manual feed tray 113. A leading end of the fed sheet is abutted against registration rollers 114 to stop once, and then the sheet is transported between the photosensitive drum 102 and a transferring portion 104 at a timing when the transportation is synchronized with a start of irradiation of the laser beam. In this case, the leading end of the sheet is abutted against the registration rollers 114 to stop once, thereby correcting a skew feed of the sheet.

Next, the developer image formed on the photosensitive drum 102 is transferred onto the fed sheet by the transferring portion 104. The sheet onto which the developer image is transferred is transported to a fixing portion 105. The fixing portion 105 fixes the developer image on the sheet by heating and pressurizing the sheet. The sheet passing through the fixing portion 105 is transported toward a flapper 118 by transport rollers 115, and is further transported toward delivery rollers 116 by the flapper 118. Then, the sheet is delivered to the finisher 800 from the printer 100 through the delivery rollers 116. At this time, the sheet is delivered in a face-up state.

Alternatively, it is possible to deliver the sheet to the finisher 800 in a face-down state. When the sheet is delivered in the face-down state, the flapper 118 is switched so as to guide the sheet, which has passed through the fixing portion 105, into a sheet-surface reverse transport path 120. The sheet is transported into the sheet-surface reverse transport path 120 through the flapper 118 by the transport rollers 117 and 119. The sheet transported to the sheet-surface reverse transport path 120 is turned over (i.e., switched back) in the transport direction of the sheet. The flapper 118 is switched so that the sheet transported from the sheet-surface reverse transport path 120 is guided into the delivery rollers 116. As a result, front and rear surfaces of the sheet are reversed. Then, the sheet of which front and rear surfaces are reversed is delivered from the printer 100 to the finisher 800 through the delivery rollers 116.

The finisher 800 includes a first punch unit 700 and a staple stacker portion 500, and is capable of performing various post-processing such as staple processing, punch processing, and sorting with respect to a sheet stack obtained by bundling a plurality of sheets.

The first punch unit 700 is a unit used for performing the thirty-hole punch processing. The first punch unit 700 includes entrance delivery rollers 701 for transporting the sheet delivered from the printer 100 into the first punch unit 700. The sheet transported into the first punch unit 700 is transported toward delivery rollers 712 or is transported toward transport rollers 703 according to a switching operation of a flapper 702. Here, when the sheet is transported toward the delivery rollers 712 by the flapper 702, the sheet is transported directly to the staple stacker portion 500 by passing through the first punch unit 700. Alternatively, when the sheet is transported toward the transport rollers 703 by the flapper 702, the sheet is subjected to the thirty-hole punch processing.

At a downstream side of the transport rollers 703, there are provided transport rollers 704, a sensor 705, a punch portion 706, and an abutting plate 707. The sensor 705 is a sensor for detecting a leading end of a sheet. The punch portion 706 performs the thirty-hole punch processing for punching a thirty of holes, for example, 30 holes, in the leading end of the sheet (i.e., a portion which is the leading end of the sheet with respect to the transport direction of the sheet). The abutting plate 707 is normally located at a position where the sheet transport path is opened. The abutting plate 707 is rotated by 90° toward a position indicated by the dotted line of FIG. 1 at a predetermined timing, thereby being projected on the sheet transport path to abut against the leading end of the sheet. The leading end of the sheet is abutted against the abutting plate 707, thereby making it possible to position the sheet with respect to the punch portion 706 with predetermined precision.

At a downstream side of the abutting plate 707, transport rollers 708, 709, 710, and 711 are provided. The transport rollers 708, 709, 710, and 711 form a transport path for guiding the sheet into the delivery rollers 712.

The staple stacker portion 500 includes entrance rollers 501 for transporting the sheet delivered from the first punch unit 700 into the staple stacker portion 500. The sheet transported through the entrance rollers 501 into the staple stacker portion 500 is guided into a second punch unit 530.

The second punch unit 530 performs the small-number-hole punch processing for punching a small number of holes, for example, two to four holes, in the trailing end of the sheet (i.e., a portion which is the trailing end of the sheet with respect to the transport direction of the sheet), when the small-number-hole punch processing is set. Further, the second punch unit 530 operates to transport the sheet to pass therethrough to a downstream side when the small-number-hole punch processing is not set. In the second punch unit 530, there are provided a sensor 532 for detecting a trailing end of the sheet, and an abutting plate 531 against which the trailing end of the sheet is abutted.

When the second punch unit 530 performs the small-number-hole punch processing, transport rollers provided in the second punch unit 530 is rotated in a reverse direction at a predetermined timing after the trailing end of the sheet is detected by the sensor 532. Further, the abutting plate 531 is rotated by 90° toward a position indicated by the dotted line of the figure, thereby being projected on a transport path. Then, the sheet is turned over (i.e., switched back) in the transport direction of the sheet toward the abutting plate 531 to be stopped in a state where the trailing end of the sheet is abutted against the abutting plate 531. Thus, in the state where the sheet is positioned based on the position of the trailing end of the sheet, punching of a small number of holes with respect to the trailing end of the sheet is performed. After that, the sheet is delivered toward a flapper 518 by the above-mentioned transport rollers.

The flapper 518 performs a switching operation so as to guide the sheet into a non-sort path 516 or transport rollers 502. Herein, when the post-processing such as sorting, punching, and stapling is not set, and when the sheet is delivered without being subjected to the post-processing, the sheet is guided into the non-sort path 516 by the flapper 518. The sheet guided into the non-sort path 516 is delivered onto a stack tray 510 by transport rollers 517.

When the post-processing such as sorting and stapling is set with respect to the sheet, the printer 100 delivers the sheet in the face-down state to the finisher 800. Then, the sheet transported to the finisher 800 is transported into the staple stacker portion 500 through the first punch unit 700, and is then guided to the transport rollers 502 by the flapper 518. Subsequently, the sheet is delivered onto a stack delivery belt 503 by the transport rollers 502. Here, at a position parallel to and a several millimeters higher than the stack delivery belt 503, an intermediate processing tray 508 having low friction is provided, and actually, the sheet is delivered onto the intermediate processing tray 508. The delivered sheet is dropped in the lower-right direction with the aid of the gravitational force of the delivered sheet along the intermediate processing tray (i.e., the stack delivery belt 503). Further, a fan-shaped return roller 504 is rotated counterclockwise, thereby bringing a friction member, which is provided at an outer edge of the return roller 504, into contact with the sheet. By the contact of the friction member, a force of allowing the sheet to fall in the lower-right direction acts on the sheet, thereby abutting an end portion of the sheet against a stopper plate 507. As a result, alignment in a longitudinal direction (i.e., feeding direction) with respect to the sheet is performed.

Further, on the intermediate processing tray, there are provided alignment plates 506 which are positioned at a front side and a back side viewed from a front surface of the apparatus. The alignment plates 506 are driven every time the sheet is delivered onto the intermediate processing tray. Thus, alignment in a horizontal direction (i.e., width direction) with respect to the sheet on the intermediate processing tray is performed.

When the predetermined number of sheets are delivered and stacked on the intermediate processing tray, the stack delivery belt 503 is driven to deliver the sheets onto the stack tray 510 or a stack tray 511. In a case where a staple mode is set, one stack of sheets to be stapled is delivered onto the intermediate processing tray, thereby performing the alignment of the sheet in the horizontal direction by the alignment plate 506. After that, the staple unit 505 is driven to staple the sheet stack, and the stapled sheet stack is delivered onto the stack tray 510 or the stack tray 511 by the stack delivery belt 503. Herein, the stack trays 510 and 511 are structured to be ascendable/descendable. In addition, the stack trays 510 and 511 are provided with sensors 512 and 513 for detecting presence or absence of the sheet, respectively.

The staple unit 505 can move toward a back side and a front side of the processing tray with respect to the sheet on the intermediate processing tray, so the staple unit 505 can perform "corner stapling" in which a back position or a front position of a trailing end of a sheet is stapled, and "two-position stapling" in which the trailing end of the sheet is stapled at two positions. The staple positions with respect to the sheet are set by a user.

Next, a sheet transportation performed when the thirty-hole punch processing is set with respect to a sheet will be described.

When the sheet delivered from the printer 100 is transported into the first punch unit 700 by the transport rollers 701, the sheet is guided by the flapper 702 into a path provided on the side of the transport rollers 703 and 704. Subsequently, the abutting plate 707 is rotated by 90°, and rollers of the punch portion 706 is stopped after a lapse of a predetermined time since the sensor 705 has detected the leading end of the sheet. As a result, the leading end of the sheet is abutted against the abutting plate 707. Then, the punch portion 706 punches holes in the leading end of the sheet. When the punch processing is finished, the abutting plate 707 is rotated by 90° in a reverse direction, thereby returning to an original position. Subsequently, the rollers of the punch portion 706 are driven again, thereby delivering the sheet to the staple stacker portion 500 through the transport rollers 709, 710, and 711, and the delivery rollers 712.

Next, a sheet transportation performed when the small-number-hole punch processing is set with respect to a sheet will be described.

The sheet delivered from the printer 100 is transported into the staple stacker portion 500 by the transport rollers 501 through a horizontal path of the first punch unit 700, and reaches the second punch unit 530. After a lapse of a predetermined time since the trailing end of the sheet has passed through the sensor 532, the abutting plate 531 is rotated by 90° to thereby drive the transport rollers, which is provided in the second punch unit 530, in a reverse direction. Subsequently, after a lapse of a predetermined time since the sensor 532 has detected the trailing end of the sheet, the trailing end of the sheet is abutted against the abutting plate 531 to stop the transport rollers provided in the second punch unit 530. Then, punch holes are made in the trailing end of the sheet. When the punch processing is finished, the abutting plate 531 is rotated by 90° in a reverse direction to return to the original position. After that, the transport rollers of the second punch unit 530 are driven again to perform a switching operation by the flapper 518. As a result, the sheet is transported onto the stack tray 510 side or the stack tray 511 side.

The operation displaying device 600 includes a plurality of keys for setting a variety of functions or modes related to the image formation, and a displaying portion for displaying information indicating a setting state. A key signal corresponding to each key operation is outputted to an operation displaying device controlling portion 680 to be described below. The operation displaying device 600 displays the corresponding information on the displaying portion in response to a signal inputted from the operation displaying device controlling portion 680.

Figure 2:
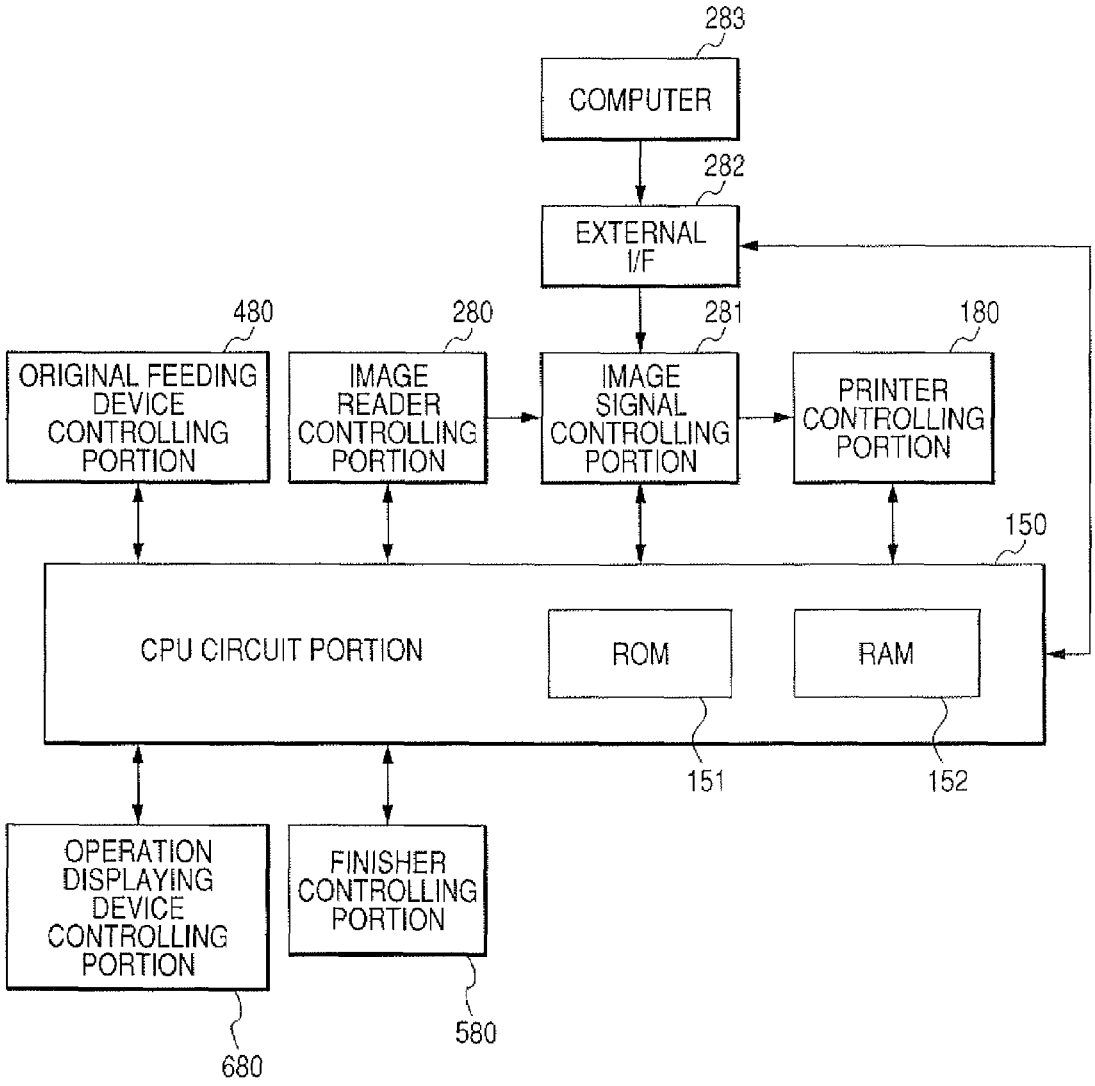
FIG. 2 is a block diagram showing a structure of a controller for controlling the whole image forming apparatus shown in FIG. 1.
Figures 3, 4:
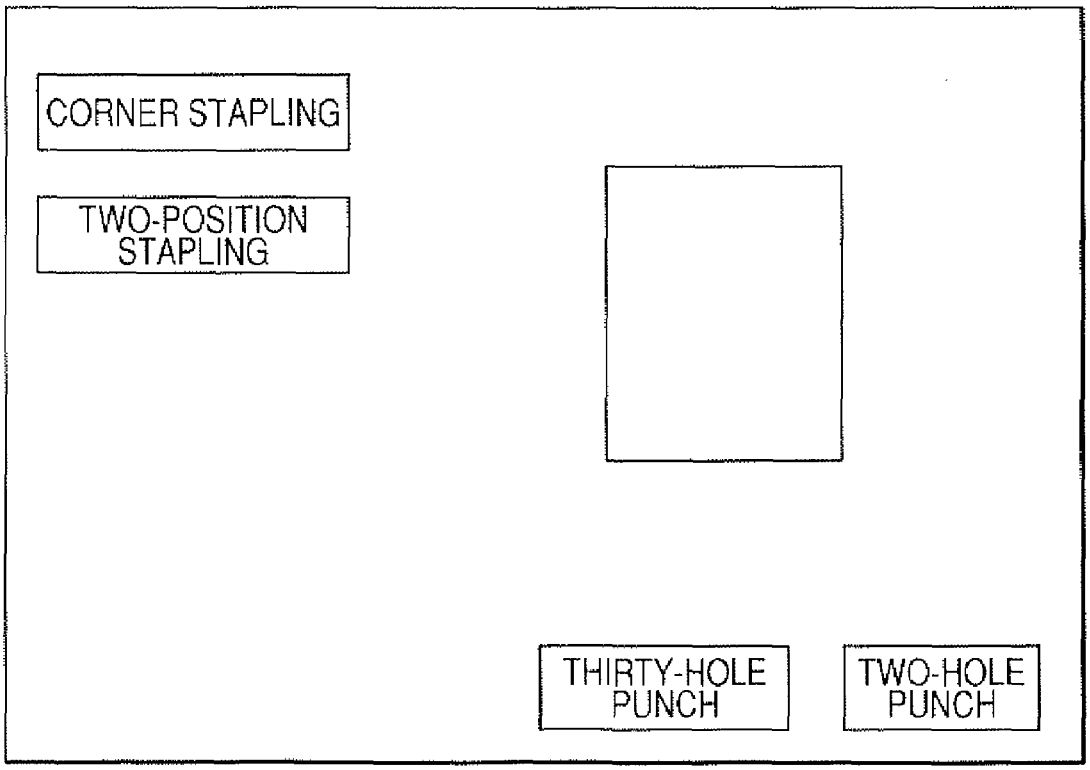
FIG. 3 is a diagram showing an example of information on an end portion to be processed which shows an end portion of a sheet to be processed by a first punch unit 700, a second punch unit 530, and a staple unit 505, and which is obtained through a finisher controlling portion 580 by a CPU circuit portion 150 shown in FIG. 2.
FIG. 4 is a diagram showing an example of a post-processing mode setting screen displayed on an operation displaying device 600.

Next, a structure of a controller for controlling the whole image forming apparatus will be described with reference to FIGS. 2 and 3. FIG. 2 is a block diagram showing the structure of the controller for controlling the whole image forming apparatus shown in FIG. 1. FIG. 3 is a diagram showing an example of information on an end portion to be processed which shows an end portion of a sheet to be processed by the first punch unit 700, the second punch unit 530, and the staple unit 505.

The controller includes a CPU circuit portion 150 as shown in FIG. 2. The CPU circuit portion 150 has a CPU (not shown), a ROM 151, and a RAM 152 built-in. Blocks 480, 280, 281, 282, 180, 680, and 580 are controlled as a whole by a control program stored in the ROM 151. The RAM 152 temporarily holds control data and is used as a work area for arithmetic processing relating to the control. At power-on, the CPU circuit portion 150 communicates with the blocks each corresponding to an original feeding device controlling portion 480, an image reader controlling portion 280, a printer controlling portion 180, and a finisher controlling portion 580, thereby obtaining structure information on each block. For example, the CPU circuit portion 150 obtains the information on the end portion to be processed which shows the end portion of the sheet to be processed by the first punch unit 700, the second punch unit 530, and the staple unit 505, as shown in FIG. 3. In this embodiment, an end portion of the sheet to be processed by the first punch unit 700 is a leading end of the sheet. On the other hand, an end portion of the sheet to be processed by the second punch unit 530 and the staple unit 505 is a trailing end of the sheet. Herein, the leading end or trailing end of the sheet is a portion which is a leading end or a portion which is a trailing end with respect to a transport direction of the sheet.

The original feeding device controlling portion 480 drives and controls the original feeding device 400 in response to an instruction from the CPU circuit portion 150. The image reader controlling portion 280 drives and controls the scanner unit 202, the image sensor 203, and the like of the image reader 200, and transfers an analog image signal outputted from the image sensor 203 to the image signal controlling portion 281.

The image signal controlling portion 281 applies each processing to the analog image signal sent from the image sensor 203 after the analog image signal is converted into a digital signal. The digital signal subjected to each processing is converted into a video signal, and is then outputted to the printer controlling portion 180. Further, the image signal controlling portion 281 applies each processing to the digital image signal inputted therein from a computer 283 through an external I/F 282. The digital image signal is outputted to the printer controlling portion 180 after being converted into the video signal. The processing operation performed by the image signal controlling portion 281 is controlled by the CPU circuit portion 150.

The printer controlling portion 180 drives the above-mentioned exposure controlling portion 101 in response to the inputted video signal. The finisher controlling portion 580 controls operations performed by the first punch unit 700 and the staple stacker portion 500 in response to the instruction sent from the CPU circuit portion 150.

The operation displaying device controlling portion 680 mediates information exchanged between the operation displaying device 600 and the CPU circuit portion 150. For example, a key signal corresponding to the operation of each key of the operation displaying device 600 is outputted to the CPU circuit portion 150 through the operation displaying device controlling portion 680. The signal sent from the CPU circuit portion 150 is outputted to the operation displaying device 600 through the operation displaying device controlling portion 680 to display the information corresponding to the signal on the operation displaying device 600.

Figure 5:
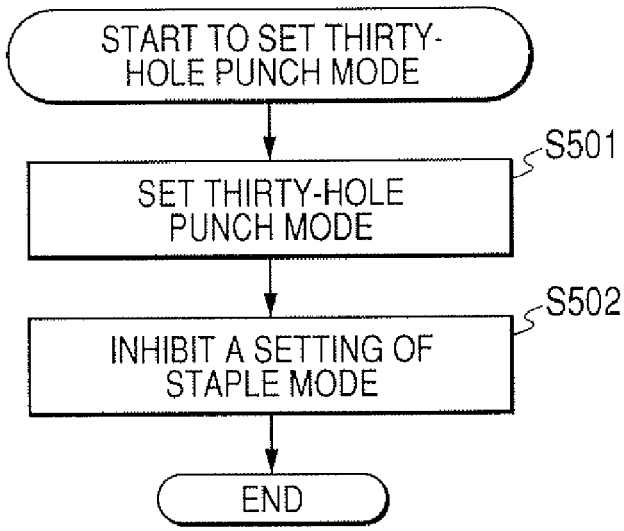
FIG. 5 is a flowchart showing a procedure of thirty-hole punch mode setting processing.
Figure 6:
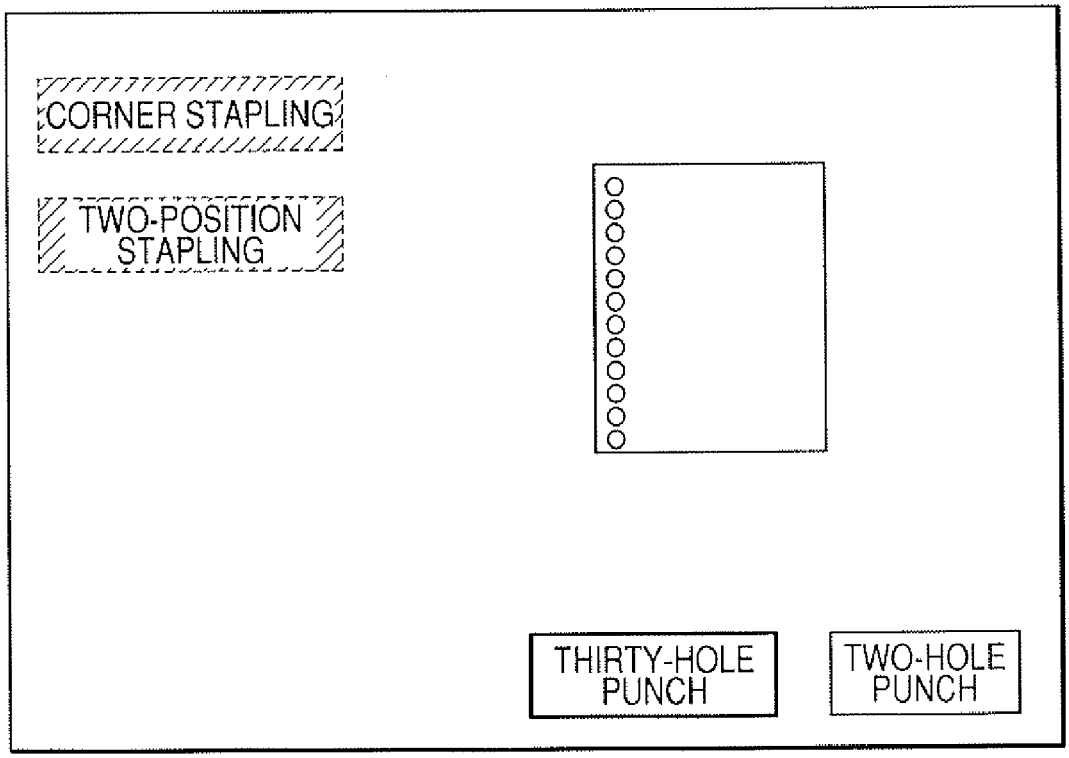
FIG. 6 is a diagram showing a setting screen in which a setting of the staple mode is inhibited.
Figure 7:
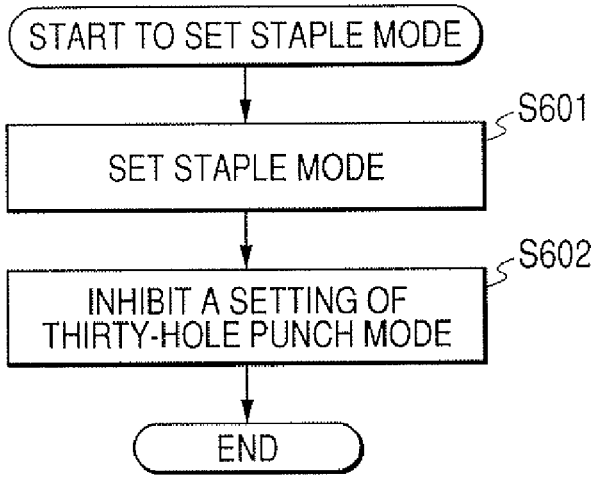
FIG. 7 is a flowchart showing a procedure of staple mode setting processing.
Figure 8:
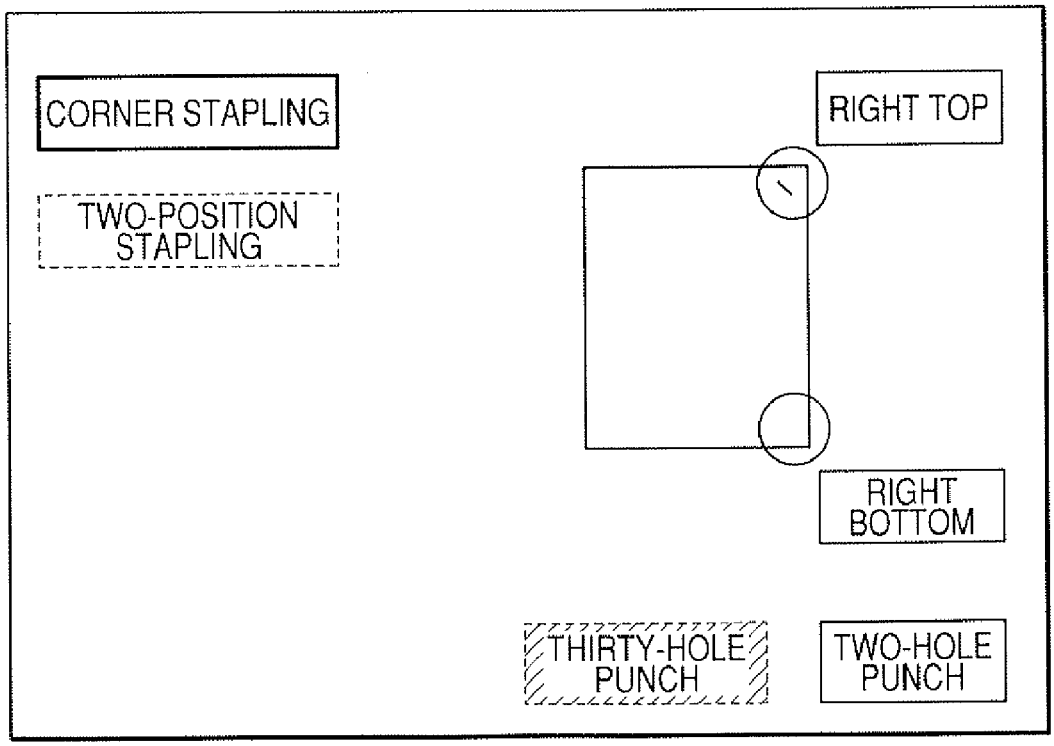
FIG. 8 is a diagram showing a setting screen in which a punch mode of "thirty-hole punch" is inhibited.
Figure 9:
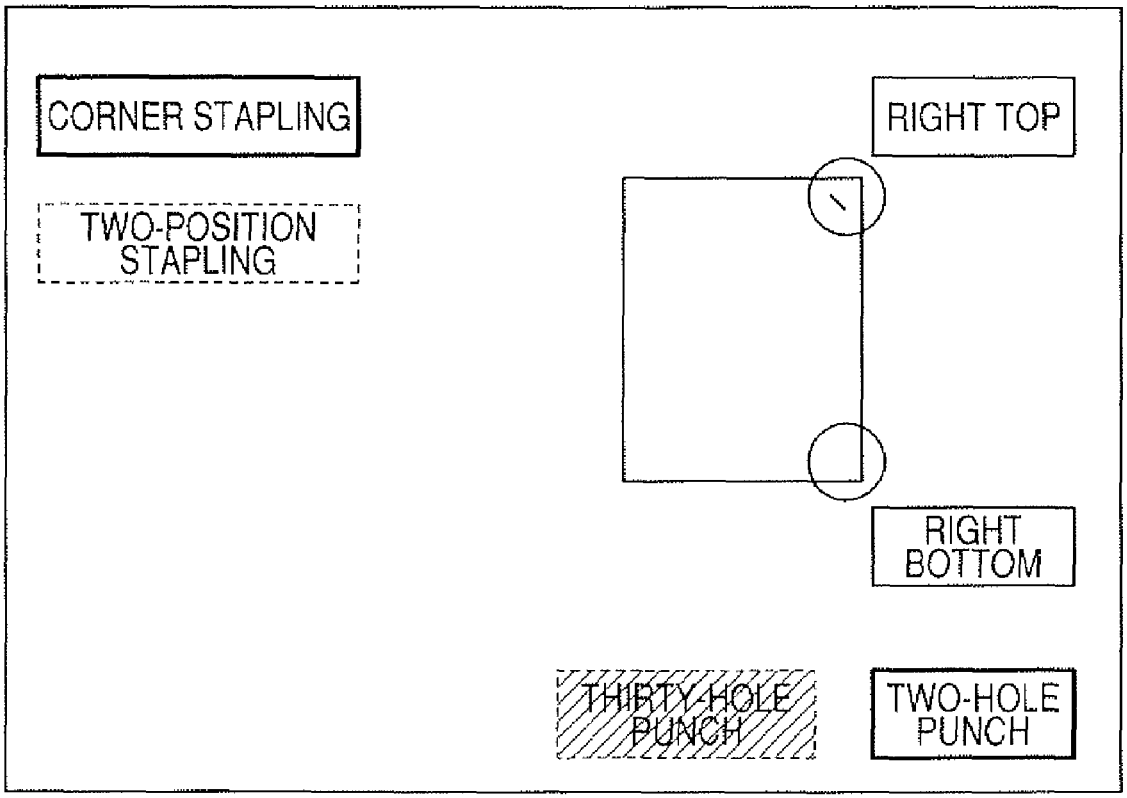
FIG. 9 is a diagram showing an example of a screen on which a staple mode of "corner stapling" and a punch mode of "two-hole punch" are selected.

Next, setting procedures of a thirty-hole punch mode and a staple mode, and processing of the CPU circuit portion 150 during the setting procedures will be described with reference to FIGS. 4 to 9. FIG. 4 is a diagram showing an example of a post-processing mode setting screen displayed on the operation displaying device 600. FIG. 5 is a flowchart showing a procedure of a thirty-hole punch mode. FIG. 6 is a diagram showing a setting screen in which a setting of the staple mode is inhibited. FIG. 7 is a flowchart showing a procedure of staple mode setting processing. FIG. 8 is a diagram showing a setting screen in which a punch mode of "thirty-hole punch" is inhibited. FIG. 9 is a diagram showing an example of a setting screen in a case where a staple mode of "corner stapling" and a punch mode of "two-hole punch" are selected.

On the operation displaying device 600, according to an operation by a user, as shown in FIG. 4, a post-processing mode setting screen for setting the post-processing mode is displayed. In this embodiment, on the post-processing mode setting screen, a desired mode can be selected from among the modes of "corner stapling", "two-position stapling", "thirty-hole punch", and "two-hole punch".

Here, for example, when the punch mode of "thirty-hole punch" is selected on the post-processing mode setting screen, the CPU circuit portion 150 starts the thirty-hole punch mode setting processing shown in FIG. 5. The CPU circuit portion 150 first recognizes a button of "thirty-hole punch" selected on the post-processing mode setting screen to thereby set the thirty-hole punch mode (Step S501). Then, the CPU circuit portion 150 inhibits each setting of the staple modes of "corner stapling" and "two-position stapling" (Step S502). By the processing, the post-processing mode setting screen is switched to a screen shown in FIG. 6. Then, on the screen shown in FIG. 6, an image representing a content of the processing (e.g., punch position) with respect to a sheet in the punch mode of "thirty-hole punch" is displayed. Buttons corresponding to "corner stapling" and "two-position stapling" are displayed in gray out, thereby making it impossible to perform an operation of selecting those buttons. As a result, when the punch mode of "thirty-hole punch", in other words, the thirty-hole punch mode is set, the staple modes of "corner stapling" and "two-position stapling" cannot be set.

Further, when "corner stapling" or "two-position stapling" is selected on the post-processing mode setting screen shown in FIG. 4, the CPU circuit portion 150 starts staple mode setting processing shown in FIG. 7. The CPU circuit portion 150 first sets a staple mode (Step S601). Then, the CPU circuit portion 150 inhibits a setting of the thirty-hole punch mode (Step S602). By the processing, the post-processing mode setting screen shown in FIG. 4 is switched to a screen shown in FIG. 8. On the screen shown in FIG. 8, a button corresponding to "thirty-hole punch" is displayed in gray out to prevent the punch mode of "thirty-hole punch" from being selected. In addition, on the screen shown in FIG. 8, "corner stapling" is selected as a staple mode, and on this screen, a staple position corresponding to the staple mode is selected. In this embodiment, a right-top position (i.e., back-side position of a trailing end of a sheet) is selected as the staple position corresponding to the staple mode.

When the staple mode of "corner stapling" or "two-position stapling" is selected, a button corresponding to the punch mode of "two-hole punch" is displayed so that the operation can be selected. When the punch mode of "two-hole punch" is selected, a button corresponding to the staple mode of "corner stapling" or "two-position stapling" is displayed so that the operation can be selected.

For example, when the staple mode of "corner stapling" and the punch mode of "two-hole punch" are selected, a screen shown in FIG. 9 is to be displayed. On the screen, a right-top position is selected as a staple position corresponding to the staple mode. Further, the button corresponding to "thirty-hole punch" is displayed in gray out, thereby making it impossible to be selected.

As described above, in this embodiment, when the thirty-hole punch mode of "thirty-hole punch" is set, the buttons each corresponding to "corner stapling" and "two-position stapling" are displayed in gray out, thereby inhibiting the settings of the staple modes of "corner stapling" and "two-position stapling". Meanwhile, when the staple modes of "corner stapling" and "two-position stapling" are set, the button corresponding to "thirty-hole punch" is displayed in gray out, thereby inhibiting the setting of the thirty-hole punch mode of "thirty-hole punch". As a result, it is possible to prevent in advance a setting from being performed by an inappropriate combination of the thirty-hole punch mode and the staple mode, in which an end portion to be processed differs, so there may cause a failure in the product.

Second Embodiment

Figure 10:
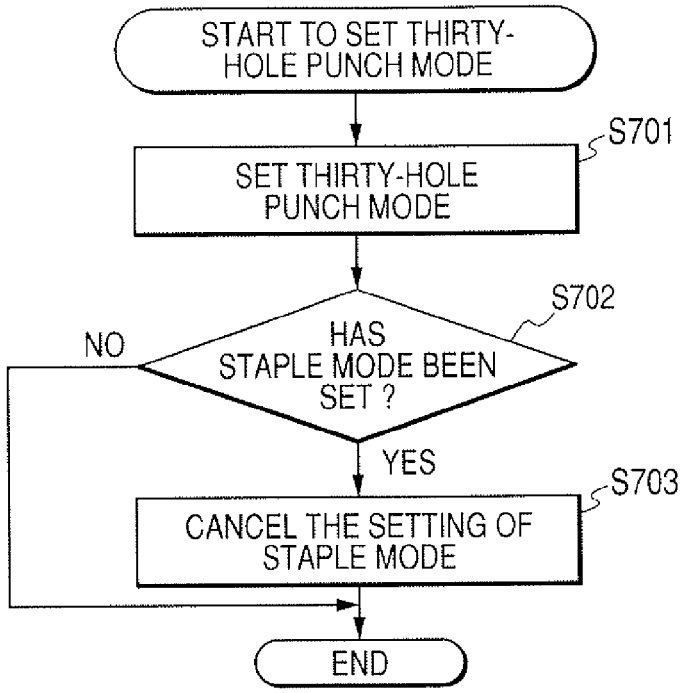
FIG. 10 is a flowchart showing a procedure of thirty-hole punch mode setting processing of an image forming apparatus according to a second embodiment of the present invention.
Figure 11:
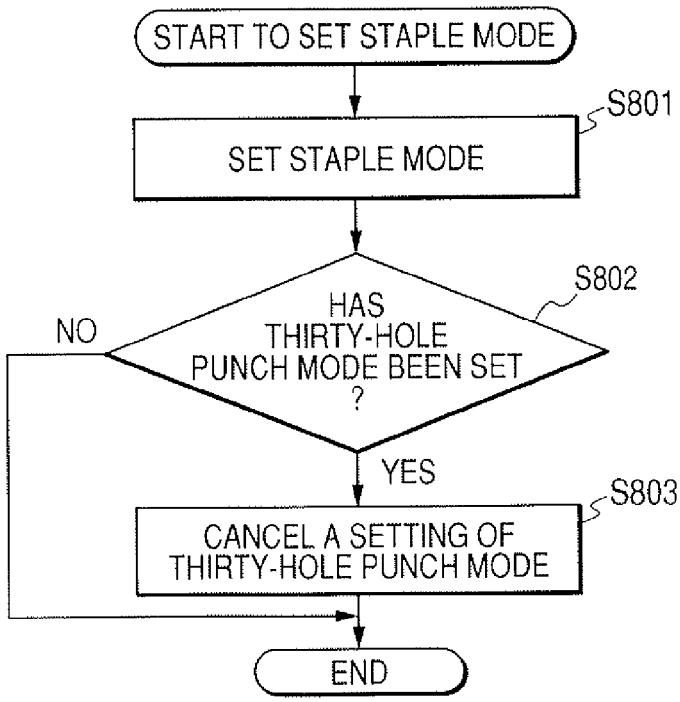
FIG. 11 is a flowchart showing a procedure of staple mode setting processing of an image forming apparatus according to the second embodiment of the present invention.

Next, a second embodiment of the present invention will be described with reference to FIGS. 10 and 11. FIG. 10 is a flowchart showing a procedure of thirty-hole punch mode setting processing of an image forming apparatus according to the second embodiment. FIG. 11 is a flowchart showing a procedure of staple mode setting processing of an image forming apparatus according to the second embodiment.

In the second embodiment, the setting procedures of the thirty-hole punch mode and the staple mode and the processing of the CPU circuit portion 150 during the procedures are different from those in the first embodiment. The other points of the second embodiment are the same as those in the first embodiment. Accordingly, functional blocks and the like of the second embodiment are given by the same reference numerals as those in the first embodiment.

To be specific, when the punch mode of "thirty-hole punch" is selected on the post-processing mode setting screen shown in FIG. 4, the CPU circuit portion 150 starts thirty-hole punch mode setting processing shown in FIG. 10. The CPU circuit portion 150 first sets the thirty-hole punch mode (Step S701). Then, the CPU circuit portion 150 determines whether or not the staple mode has been set (Step S702). Herein, when determining that the staple mode has been set, the CPU circuit portion 150 cancels the setting of the staple mode (Step S703). After that, the CPU circuit portion 150 ends this processing. Meanwhile, when determining that the staple mode has not been set, the CPU circuit portion 150 does not perform any other processing to end this processing.

On the post-processing mode setting screen shown in FIG. 4, when the staple mode of "corner stapling" or "two-position stapling" is selected, the CPU circuit portion 150 starts staple mode setting processing shown in FIG. 11. The CPU circuit portion 150 first sets a staple mode (Step S801). Then, the CPU circuit portion 150 determines whether or not the thirty-hole punch mode has been set (Step S802). Herein, when determining that the thirty-hole punch mode has been set, the CPU circuit portion 150 cancels the setting of the thirty-hole punch mode (Step S803). After that, the CPU circuit portion 150 ends this processing. Meanwhile, when determining that the thirty-hole punch mode has not been set, the CPU circuit portion 150 does not perform any other processing to end this processing.

Third Embodiment

Figure 12:
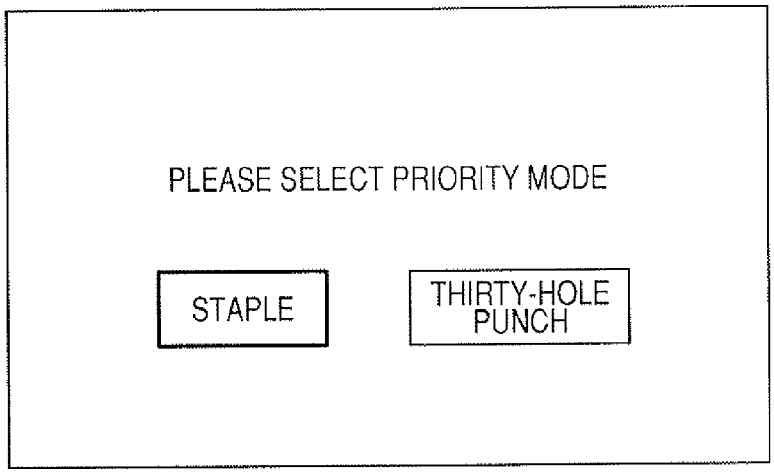
FIG. 12 is a diagram showing an example of a priority post-processing mode selection screen displayed on an operation displaying device of an image forming apparatus according to a third embodiment of the present invention.
Figure 13:
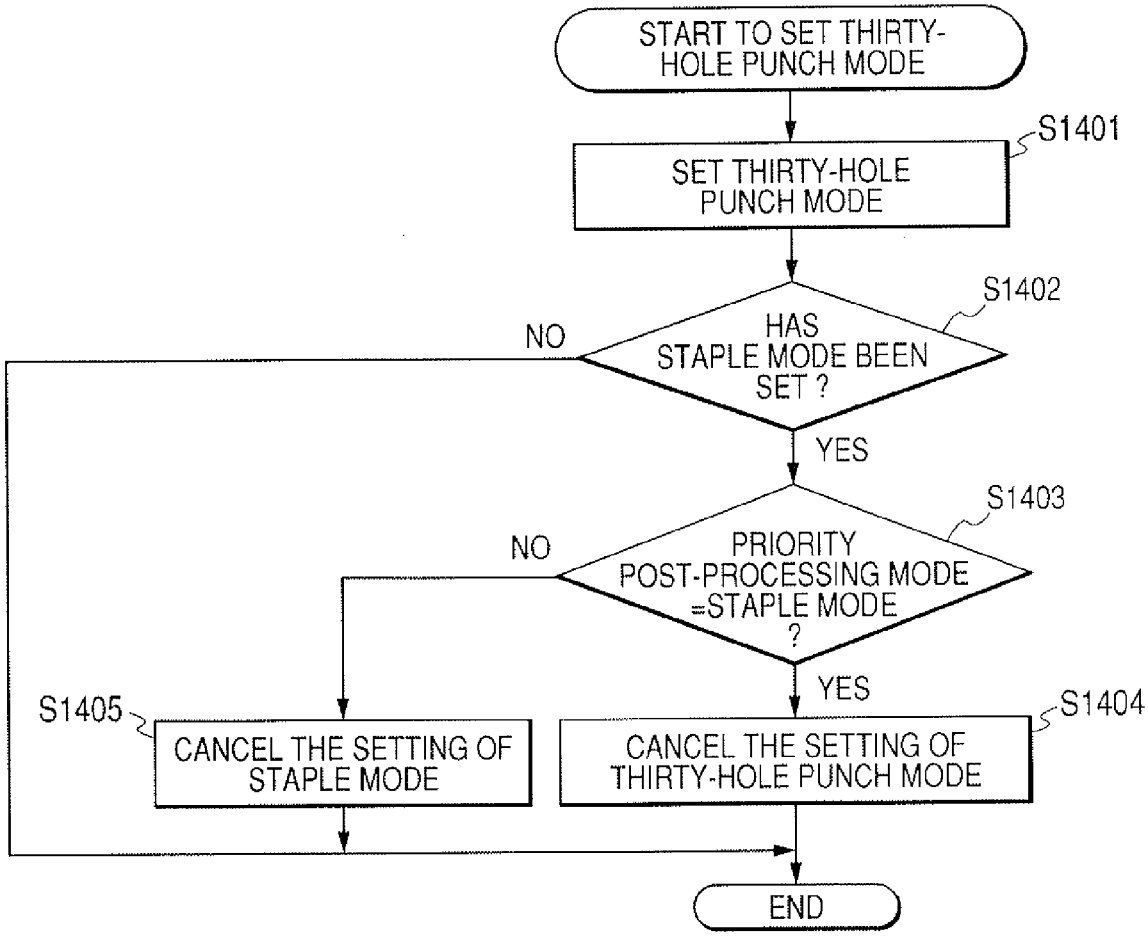
FIG. 13 is a flowchart showing a procedure of thirty-hole punch mode setting processing of the image forming apparatus according to the third embodiment of the present invention.
Figure 14:
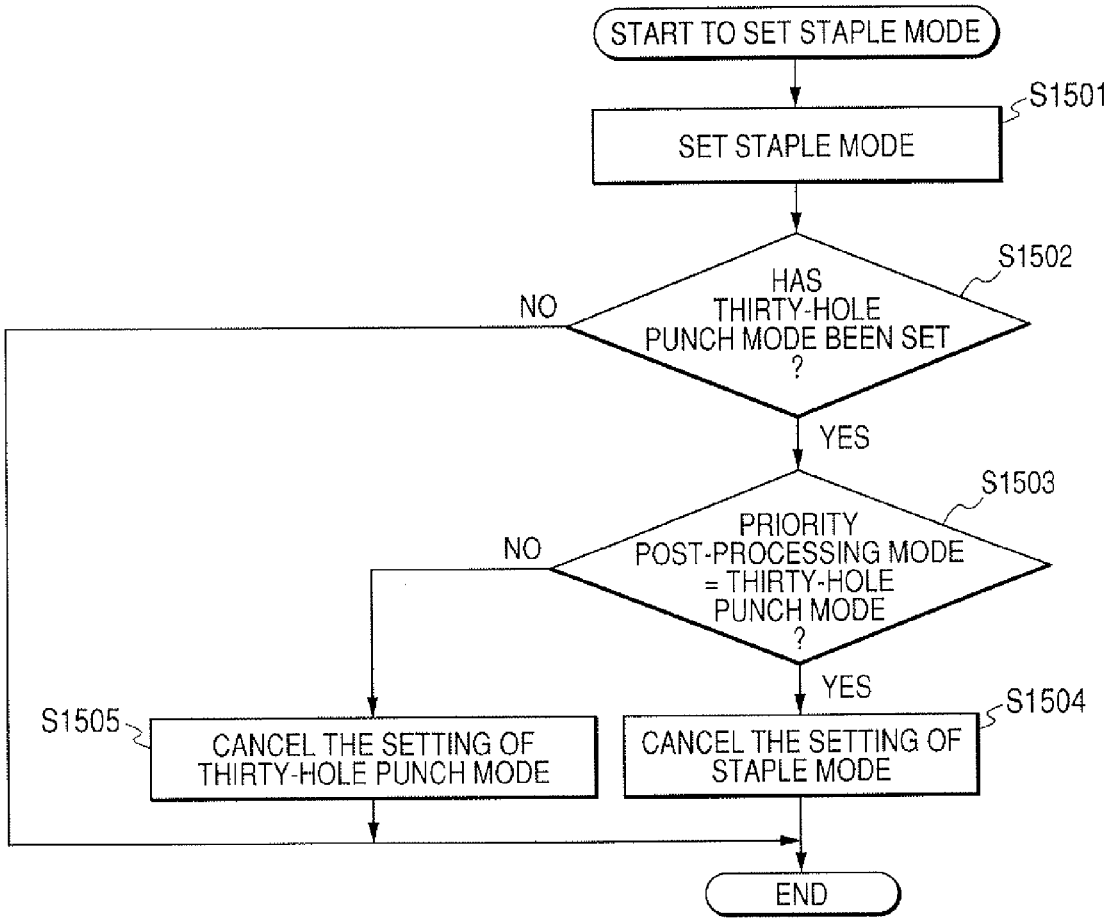
FIG. 14 is a flowchart showing a procedure of staple mode setting processing of the image forming apparatus according to the third embodiment of the present invention.

Next, a third embodiment of the present invention will be described with reference to FIGS. 12 to 14. FIG. 12 is a diagram showing an example of a priority post-processing mode selection screen displayed on an operation displaying device of an image forming apparatus according to the third embodiment. FIG. 13 is a flowchart showing a procedure of thirty-hole punch mode setting processing of the image forming apparatus according to the third embodiment. FIG. 14 is a flowchart showing a procedure of staple mode setting processing of the image forming apparatus according to the third embodiment.

In the third embodiment, the setting procedures of the thirty-hole punch mode and the staple mode and the processing of the CPU circuit portion 150 during the procedures are different from those in the first embodiment. The other points of the third embodiment are the same as those in the first embodiment. Accordingly, functional blocks and the like of this embodiment are given by the same reference numerals as those in the first embodiment.

On the operation displaying device 600, in accordance with a menu selection by a user, a priority post-processing mode selection screen is displayed as shown in FIG. 12. The priority post-processing mode selection screen is a screen for selecting between the thirty-hole punch mode and the staple mode as a priority mode. In this case, the selected priority post-processing mode is held in the RAM 152 of the CPU circuit portion 150.

For example, when the punch mode of "thirty-hole punch" is selected on the post-processing mode setting screen shown in FIG. 4, the CPU circuit portion 150 starts thirty-hole punch mode setting processing shown in FIG. 13. The CPU circuit portion 150 first sets the thirty-hole punch mode (Step S1401). Then, the CPU circuit portion 150 determines whether or not the staple mode has been set (Step S1402). Herein, when determining that the staple mode has been set, the CPU circuit portion 150 determines whether or not the staple mode has been selected as the above-mentioned priority post-processing mode (Step S1403). When determining that the staple mode has been selected as the priority post-processing mode, the CPU circuit portion 150 cancels the setting of the thirty-hole punch mode (Step S1404). After that, the CPU circuit portion 150 ends this processing. Meanwhile, when determining that the staple mode has not been selected as the priority post-processing mode, in other words, that the punch mode has been selected, the CPU circuit portion 150 cancels the setting of the staple mode (Step S1405). After that, the CPU circuit portion 150 ends this processing.

When determining that the staple mode has not been set in Step S1402, the CPU circuit portion 150 does not perform any other processing to end this processing.

On the post-processing mode setting screen shown in FIG. 4, when the staple mode of "corner stapling" or "two-position stapling" is selected, the CPU circuit portion 150 starts staple mode setting processing shown in FIG. 14. The CPU circuit portion 150 first sets a staple mode (Step S1501). Then, the CPU circuit portion 150 determines whether or not the thirty-hole punch mode has been set (Step S1502). Herein, when determining that the thirty-hole punch mode has been set, the CPU circuit portion 150 determines whether or not the thirty-hole punch mode has been set as the above-mentioned priority post-processing mode (Step S1503). When determining that the thirty-hole punch mode has been set as the priority post-processing mode, the CPU circuit portion 150 cancels the setting of the staple mode (Step S1504) to end this processing. Meanwhile, when determining that the thirty-hole punch mode has not been selected as the priority post-processing mode, in other words, that the staple mode has been selected, the CPU circuit portion 150 cancels the setting of the thirty-hole punch mode (Step S1505). After that, the CPU circuit portion 150 ends this processing.

When determining that the thirty-hole punch mode has not been set in Step S1502, the CPU circuit portion 150 does not perform any other processing to end this processing.

Fourth Embodiment

Figure 15:
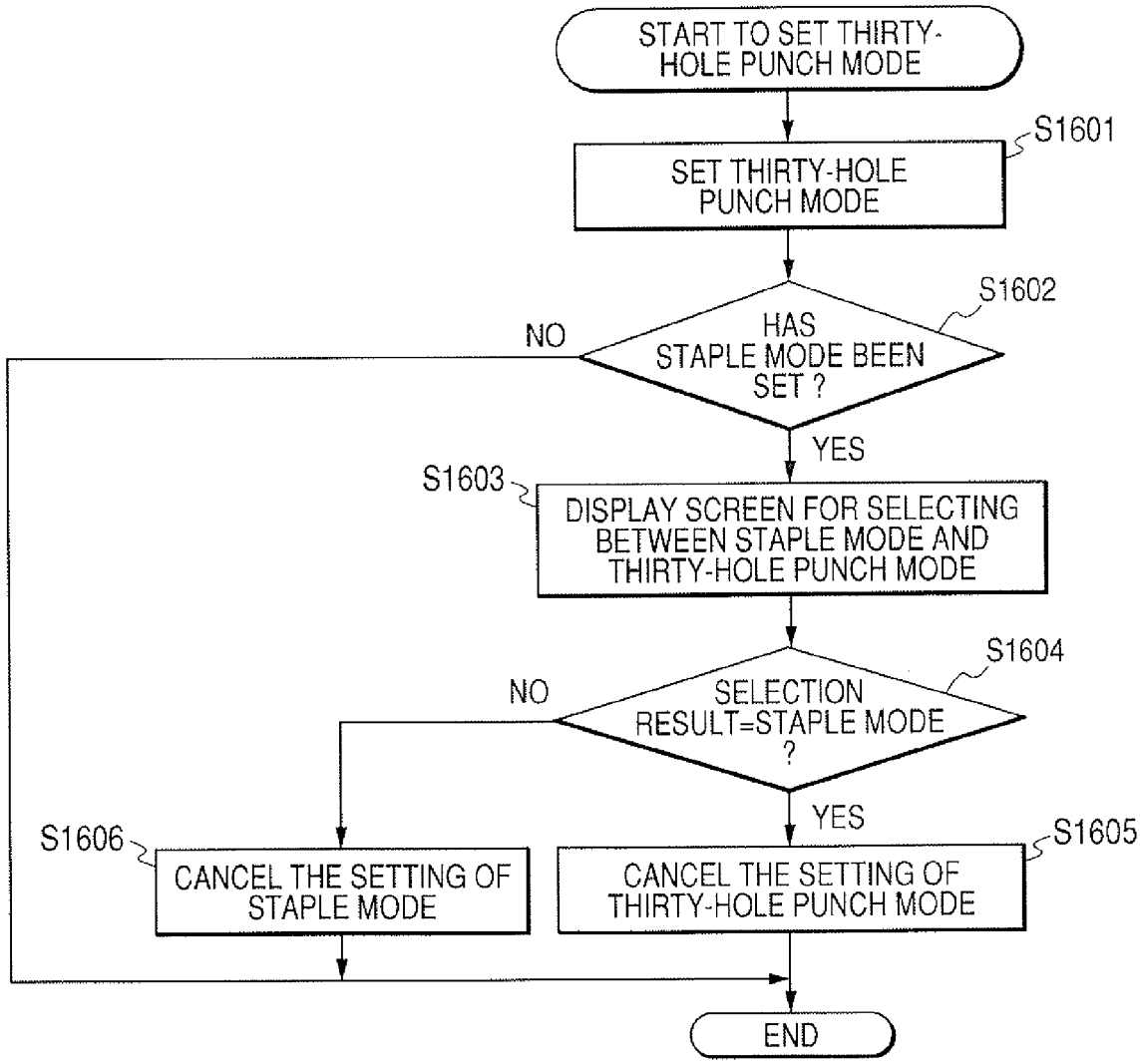
FIG. 15 is a flowchart showing a procedure of thirty-hole punch mode setting processing of an image forming apparatus according to a fourth embodiment of the present invention.
Figure 16:
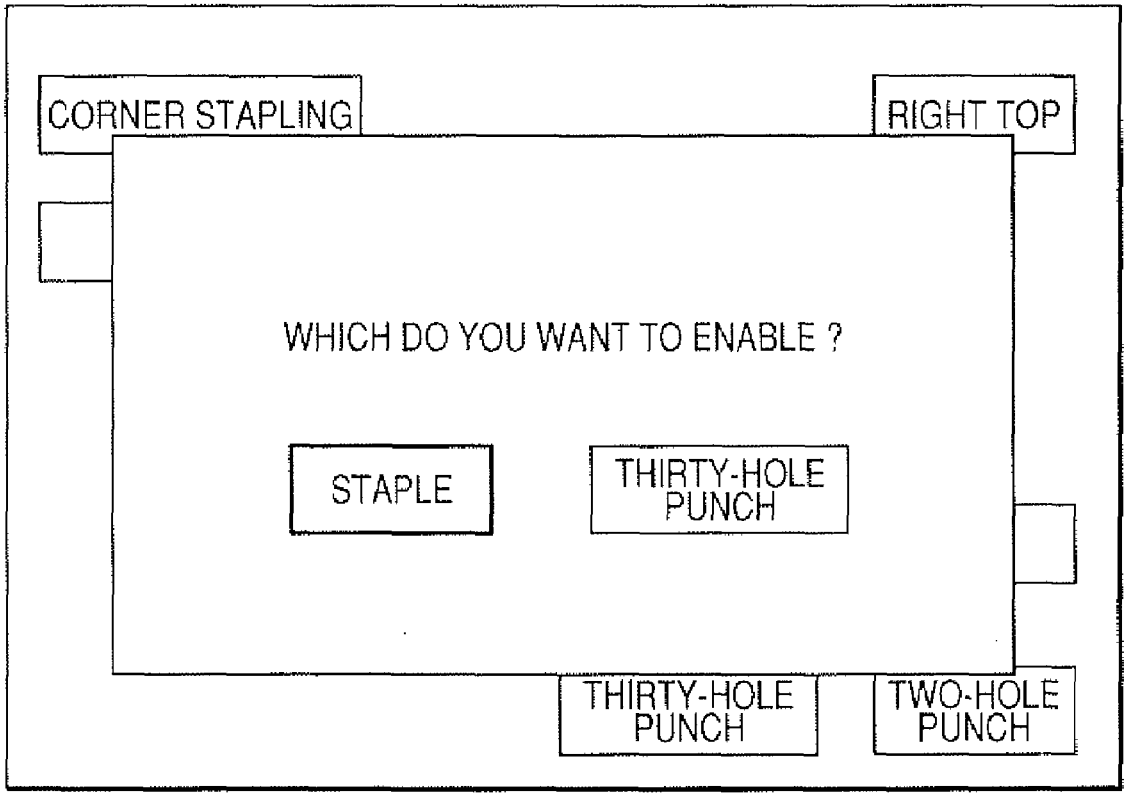
FIG. 16 is a diagram showing an example of a screen for selecting which of the staple mode (i.e., "binding") and the punch mode (i.e., "thirty-hole punch") is to be enabled, which are displayed in Step S1603 of FIG. 15.
Figure 17:
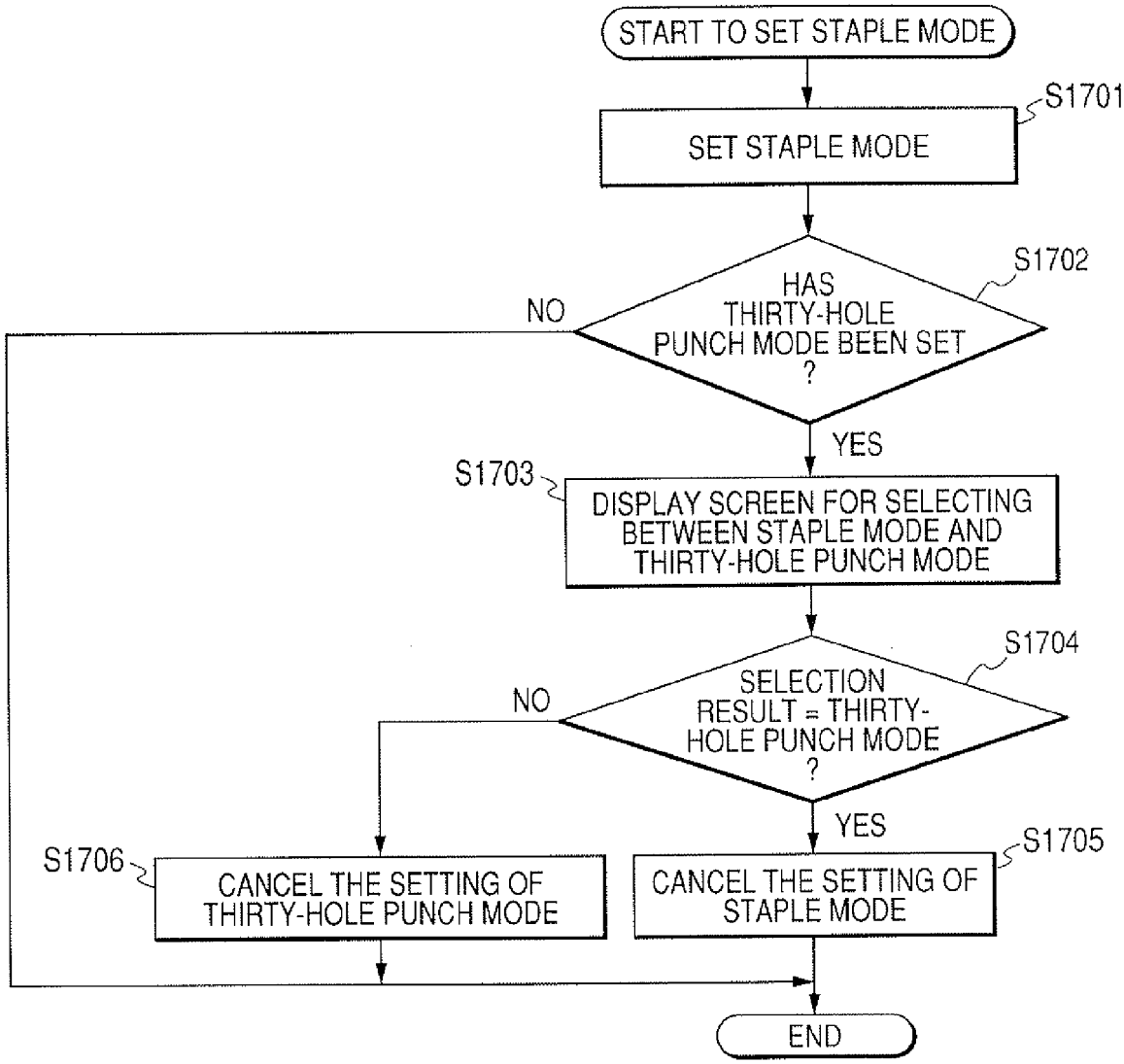
FIG. 17 is a flowchart showing a procedure of staple mode setting processing of the image forming apparatus according to the fourth embodiment of the present invention.
Figure 18:
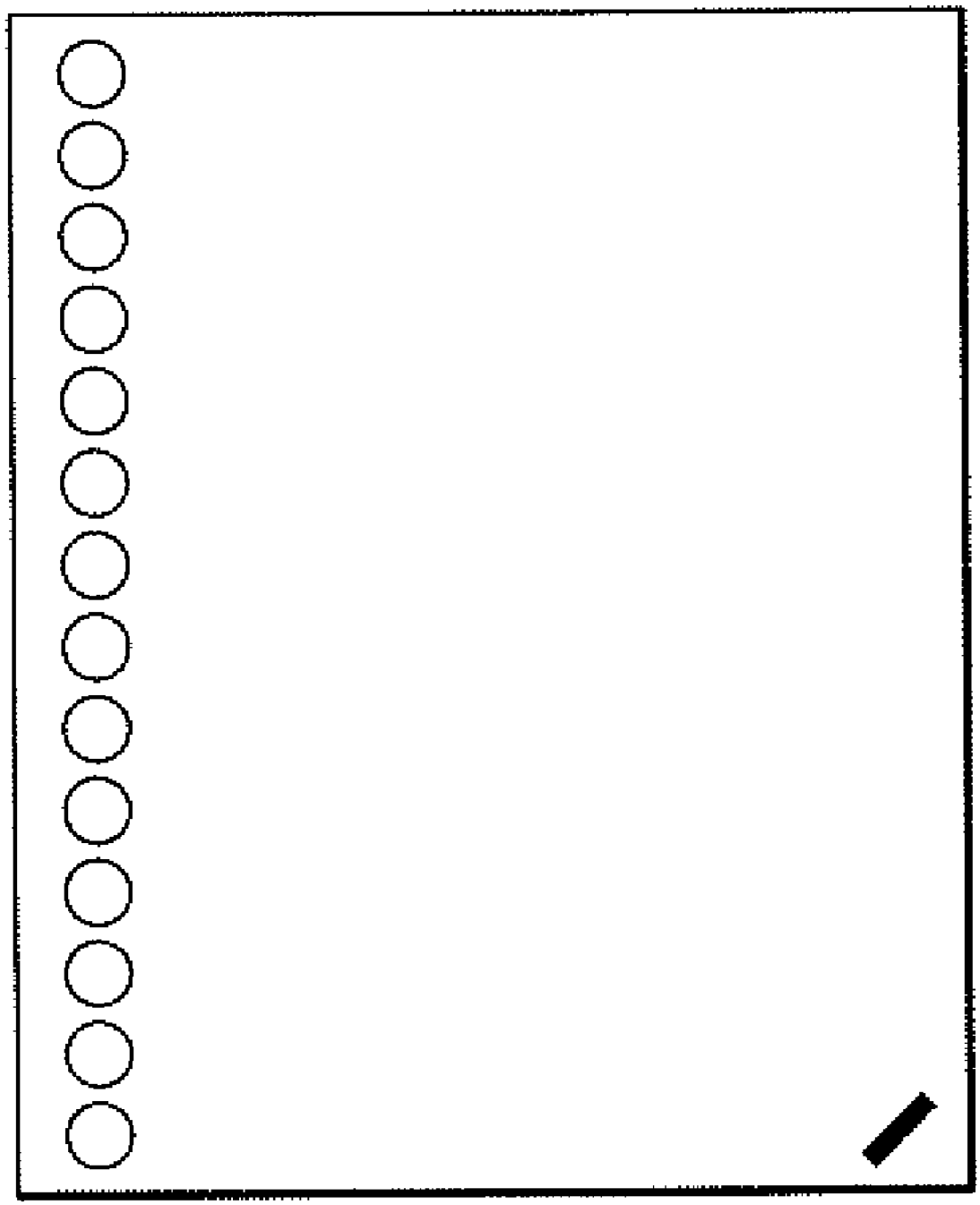
FIG. 18 is a diagram showing an example of a product obtained in a case where thirty-hole punch processing and staple processing are performed by using a thirty-hole punch unit with respect to a leading end of a sheet in a conventional sheet processing apparatus.

Next, a fourth embodiment of the present invention will be described with reference to FIGS. 15 to 17. FIG. 15 is a flowchart showing a procedure of thirty-hole punch mode setting processing of an image forming apparatus according to the fourth embodiment. FIG. 16 is a diagram showing an example of a screen for selecting between the staple mode (i.e., "staple") and the punch mode (i.e., "thirty-hole punch") to be enabled, which are displayed in Step S1603 of FIG. 15. FIG. 17 is a flowchart showing a procedure of staple mode setting processing of the image forming apparatus according to the fourth embodiment.

In the fourth embodiment, the setting procedures of the thirty-hole punch mode and the staple mode and the processing of the CPU circuit portion 150 during the procedures are different from those in the first embodiment. The other points of the fourth embodiment are the same as those in the first embodiment. Accordingly, functional blocks and the like of the fourth embodiment are given by the same reference numerals as those in the first embodiment.

For example, when the punch mode of "thirty-hole punch" is selected on the post-processing mode setting screen shown in FIG. 4, the CPU circuit portion 150 starts thirty-hole punch mode setting processing shown in FIG. 15. The CPU circuit portion 150 first sets the thirty-hole punch mode (Step S1601). Then, the CPU circuit portion 150 determines whether or not the staple mode has been set (Step S1602). Herein, when determining that the staple mode has been set, the CPU circuit portion 150 displays a screen for selecting between the staple mode (i.e., "stapling") and the thirty-hole punch mode (i.e., "thirty-hole punch") to be enabled on the operation displaying device 600 (Step S1603). A user selects between the staple mode (i.e., "stapling") and the thirty-hole punch mode (i.e., "thirty-hole punch") as a mode to be enabled, on the display of the operation displaying device 600.

Then, the CPU circuit portion 150 determines whether or not the mode selected by the user on the screen is the staple mode (Step S1604). Herein, when determining that the selected mode is the staple mode, the CPU circuit portion 150 cancels the setting of the thirty-hole punch mode (Step S1605) to end this processing. Meanwhile, when determining that the mode selected by the user is not the staple mode, in other words, that the selected mode is the punch mode, the CPU circuit portion 150 cancels the setting of the staple mode (Step S1606) to end this processing.

When determining that the staple mode has not been set in Step S1602, the CPU circuit portion does not perform any other processing to end this processing.

On the post-processing mode setting screen shown in FIG. 4, the staple mode of "corner stapling" or "two-position stapling" is selected, the CPU circuit portion 150 starts staple mode setting processing shown in FIG. 17. The CPU circuit portion 150 first sets a staple mode (Step S1701). Then, the CPU circuit portion 150 determines whether or not the thirty-hole punch mode has been set (Step S1702). Herein, when determining that the thirty-hole punch mode has been set, the CPU circuit portion 150 displays on the operation displaying device 600 a screen for selecting between the staple mode (i.e., "stapling") and the great-number-hole punch mode (i.e., "thirty-hole punch") to be enabled as shown in FIG. 16 (Step S1703).

Then, the CPU circuit portion 150 determines whether or not the mode selected by the user on the screen is the thirty-hole punch mode (Step S1704). Herein, when determining that the selected mode is the thirty-hole punch mode, the CPU circuit portion 150 cancels the setting of the staple mode (Step S1705) to end this processing. Meanwhile, when determining that the mode selected by the user on the screen is not the thirty-hole punch mode, in other words, that the selected mode is the staple mode, the CPU circuit portion 150 cancels the setting of the thirty-hole punch mode (Step S1706) to end this processing.

When determining that the thirty-hole punch mode has not been set in Step S1702, the CPU circuit portion 150 does not perform any other processing to end this processing.

The object of the present invention is also attained by supplying a system or a device with a recording medium on which a program code of software for realizing the functions according to the embodiments, and by reading and executing the program code stored in the recording medium using a computer (or a CPU, an MPU, or the like) of the system or the device.

In this case, the program code itself, which is read out from the recording medium, realizes the functions according to the above-mentioned embodiments, whereby the recording medium on which the program code is stored constitutes the present invention.

For the recording medium for supplying the program code, for example, a floppy (registered trademark) disk, a hard disk, a magnetic optical disk, a CD-ROM, a CD-R, a CD-RW, a DVD-ROM, a DVD-RAM, a DVD-RW, a DVD+RW, a magnetic tape, a nonvolatile memory card, and a ROM may be used. Alternatively, the program code may be downloaded via a network.

By executing the program code read by the computer, the functions according to the embodiments are realized, and in addition, there is another possibility that, in response to an instruction of the program code, an operating system (OS) or the like which operates on the computer performs a part of or the whole of the actual processing, thereby realizing the functions according to the embodiments.

Further, there is still another possibility that the program code read out from the recording medium is written in a memory provided to a function extension board inserted in the computer or a function extension unit connected to the computer, and then, in response to the instruction of the program code, the CPU or the like provided to the function extension board or the function extension unit performs a part of or the whole of the actual processing, thereby realizing the functions according to the embodiments.

In the present invention, by executing the program code read out from the computer, the functions according to the embodiments are realized, and in addition, there is a possibility that, in response to the program code, the OS or the like which operates on the computer performs a part of or the whole of the actual processing, thereby realizing the functions according the embodiments.

In this case, the program is directly supplied from the recording medium on which the program is stored, or is supplied by being downloaded from another computer or database (not shown) and the like which is connected via the Internet, a commercial network, a local area network, or the like.

In the above-mentioned embodiments, the electrophotographic process is adopted as the printing method. However, the present invention is not limited to the electrophotographic process, and can be adapted to a variety of printing methods such as ink-jet printing method, thermal transfer printing method, thermal printing method, electrostatic printing method, and discharge-breakdown printing method.

The form of the program may be constituted by script data or the like supplied to the program code executed by an object code and an interpreter, and to an operating system (OS).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-250117, filed Aug. 30, 2005, which is hereby incorporated by reference herein in its entirety.

What is claimed is:

1. An image forming apparatus, comprising:

an image forming device which forms an image on a sheet;

a stapling device which applies staple processing to a portion assuming a trailing end of the sheet with respect to a transport direction of the sheet;

a first punch device which applies a first punch processing to a portion assuming a leading end of the sheet with respect to the transport direction of the sheet;

a second punch device which applies a second punch processing to the portion assuming the trailing end of the sheet with respect to the transport direction of the sheet;

a mode setting device which sets a post-processing mode including a staple mode for performing the staple processing by the stapling device, a first punch mode for performing the first punch processing by the first punch device, and a second punch mode for performing the second punch processing by the second punch device; and a controller which inhibits a setting of both the staple mode by the stapling device and the first punch mode by the first punch device, and allows a setting of both the staple mode by the stapling device and the second punch mode by the second punch device.

2. An image forming apparatus according to claim 1, wherein the controller controls the mode setting device to inhibit a setting of the staple mode when the first punch mode is set, and to inhibit a setting of the first punch mode when the staple mode is set.

3. An image forming apparatus according to claim 1, wherein the controller controls the mode setting device to cancel a setting of the staple mode when the first punch mode is set in a state where the staple mode is set, and to cancel a setting of the first punch mode when the staple mode is set in a state where the first punch mode is set.

4. An image forming apparatus according to claim 1, wherein the controller causes the mode setting device to display a screen for selecting one of the staple mode and the first punch mode in a case where the first punch mode is set in a state where the staple mode is set or in a case where the staple mode is set in a state where the first punch mode is set.

5. An image forming apparatus according to claim 1, wherein the mode setting device has a priority mode setting function for setting one of the staple mode and the first punch mode as a priority mode; and wherein the controller controls the mode setting device to cancel a setting of one mode which is not set as the priority mode by the priority mode setting function when the other mode is set in a state where one of the staple mode and the first punch mode is set.

6. An image forming apparatus, comprising:

an image forming device which forms an image on a sheet;

a stapling device which applies staple processing to a portion assuming a trailing end of the sheet with respect to a transport direction of the sheet;

a punch device which selectively applies punch processing between a portion assuming a leading end of the sheet with respect to the transport direction of the sheet and a portion assuming a trailing end of the sheet with respect to the transport direction of the sheet;

a mode setting device which sets a post-processing mode including a staple mode for applying staple processing to a portion assuming a trailing end of a sheet with respect to the transport direction of the sheet by the stapling device, a first punch mode for applying punch processing to the portion assuming a leading end of the sheet with respect to the transport direction of the sheet by the punch device, and a second punch mode for applying punch processing to the portion assuming a trailing end of the sheet with respect to the transport direction of the sheet by the punch device; and a controller which controls the mode setting device to inhibit a setting of the staple mode when the first punch mode is set, and to inhibit a setting of the first punch mode when the staple mode is set, and to allow a setting of the second punch mode when the staple mode is set.

7. A control method for controlling an image forming apparatus that includes: a stapling device which applies staple processing to a portion assuming a trailing end of a sheet with respect to a transport direction of the sheet; a first punch device which applies punch processing to a portion assuming a leading end of the sheet with respect to the transport direction of the sheet; and a second punch device which applies the punch processing to the portion assuming the trailing end of the sheet with respect to the transport direction of the sheet, the control method comprising:

a determination step of determining a setting of a post-processing mode including a staple mode for performing the staple processing by the stapling device, a first punch mode for performing the punch processing by the first punch device, and a second punch mode for performing the punch processing by the second punch device; and a mode setting step of inhibiting a setting of both the staple mode by the stapling device and the first punch mode by the first punch device, and allowing a setting of both the staple mode by the stapling device and the second punch mode by the second punch device.

8. A control method for controlling an image forming apparatus that includes: a stapling device which applies staple processing to a portion assuming a trailing end of a sheet with respect to a transport direction of the sheet; and a punch device which selectively applies punch processing between a portion assuming a leading end of the sheet with respect to the transport direction of the sheet and a portion assuming a trailing end of the sheet with respect to the transport direction of the sheet, the control method comprising:

a determination step of determining a setting of a post-processing mode including a staple mode for applying staple processing to a portion assuming a trailing end of a sheet with respect to the transport direction of the sheet by the stapling device, a first punch mode for applying punch processing to the portion assuming a leading end of the sheet with respect to the transport direction of the sheet by the punch device, and a second punch mode for applying punch processing to the portion assuming a trailing end of the sheet with respect to the transport direction of the sheet by the punch device; and an inhibiting step of inhibiting a setting of the staple mode when the first punch mode is set, and inhibits a setting of the first punch mode when the staple mode is set, and allows a setting of the second punch mode when the staple mode is set.

9. An image forming apparatus as claimed in claim 1, wherein the first punch device is located at a first position along a transport path of the sheet and the second punch device is located at a second position along the transport path that is separate and distinct from the first position.

10. An image forming apparatus as claimed in claim 1, wherein the first punch device punches a greater number of holes in the sheet than the second punch device.

11. A control method as claimed in claim 7, wherein the first punch mode performs punch processing at a first position along a transport path of the sheet by the first punch device and the second punch mode performs punch processing at a second position along a transport path of the sheet that is separate and distinct from the first position by the second punch device.

12. A control method as claimed in claim 7, wherein the first punch mode perform punch processing to punch a greater number of holes in the sheet than the second punch mode.

* * * * *